US005396996A

United States Patent [19]

Box

[11] Patent Number: 5,396,996

[45] Date of Patent: Mar. 14, 1995

[54] STORAGE CRATE FOR HANGING FILE FOLDERS

[75] Inventor: Thomas Box, Shrewsbury, N.J.

[73] Assignee: Spectrum International Inc., Schrewsbury, N.J.

[21] Appl. No.: 953,313

[22] Filed: Sep. 29, 1992

Related U.S. Application Data

[63] Continuation of Ser. No. 713,051, Jun. 10, 1991, abandoned.

[51] Int. Cl.[6] ..... A47F 7/16

[52] U.S. Cl. ..... 211/46; 220/543; 206/425

[58] Field of Search ..... 211/46, 162; D34/40, D34/45; 206/425; 220/534, 543; 312/184

[56] References Cited

U.S. PATENT DOCUMENTS

| | | | |
|---|---|---|---|
| 1,867,159 | 7/1932 | Kline | 312/184 |
| 2,650,009 | 6/1982 | Box . | |
| 2,948,402 | 8/1960 | Patterson | 211/162 X |
| 3,098,488 | 7/1963 | Schnelle | 211/181 |
| 3,245,572 | 4/1966 | Mashy et al. | 211/72 X |
| 3,279,642 | 10/1966 | Kafferlin | 220/543 X |
| 3,379,339 | 4/1968 | Asenbauer | D34/40 X |
| 3,788,718 | 1/1974 | Bjorn et al. | 312/184 |
| 3,977,527 | 8/1976 | Rose et al. | 211/46 |
| 4,505,388 | 3/1985 | Solomon | 206/425 |
| 4,548,320 | 10/1985 | Box . | |
| 4,775,069 | 10/1988 | Stonier . | |
| 4,901,867 | 2/1990 | Petty, Jr. | 211/46 |
| 4,901,876 | 2/1990 | Box . | |

*Primary Examiner*—Ramon O. Ramirez
*Assistant Examiner*—Korie H. Chan
*Attorney, Agent, or Firm*—Hedman, Gibson & Costigan

[57] ABSTRACT

A one piece crate for storing hanging file folders, that supports the hanging file folders above the bottom of the crate and secures the hanging file folders to the support structure.

10 Claims, 3 Drawing Sheets

STORAGE CRATE FOR HANGING FILE FOLDERS

The present application is a continuation of Ser. No. 07/713051, filed October 1991,now abandoned.

FIELD OF THE INVENTION

The invention relates to a plastic crate for storing hanging file folders. More specifically, the present invention consists of resilient support structures in the upper portion of the longitudinal sides which can be flexed to allow for the reception of hanging file folders such as Pendaflexe® or Data Com® and then returned to the normal position for securing the hanging file folders in the crate.

BACKGROUND OF THE INVENTION

Crates have been used for many years for the transportation and storage of a variety of objects. At first crates were made of wood or wood and metal. More recently crates, of plastic have become common and because of the advantageous features of plastic, in many instances, the wooden, or wooden and metal crates have been replaced. The plastic crates are typically formed in one integral piece; customarily by injection molding. The usual materials for the crates are polyethylene and polypropylene. The end result is a sturdy, lightweight crate that is durable.

Plastic crates have been put to use by the public for just about every conceivable storage use probably because of the lightweight sturdy construction. One common use of plastic crates is the storage of files. Typically, files are inserted into the crate and rest on the bottom of the crate, making retrieval difficult due to the weight and hinderance the files in the crate exert on each other.

A different type of file storage system was developed to alleviate the difficulties associated with resting files on the bottom of a storage area, which employs a method of hanging files from horizontal metal rails. The metal rails can be incorporated into the storage container by the use of a cumbersome metal frame or by the insertion of metal rails into prefabricated holes in the storage container walls as taught by Stonier, U. S. Pat. No. 4,775,069. Although either method of hanging files provides for easier retrieval of stored files, both are cumbersome due to the addition of the metal frame or rails. Not only are the metal rails cumbersome, but they are unreliable because the hanging file folder can easily be jolted off the rail causing the file to disengage from the support causing the contents of the file to become disorganized.

SUMMARY OF THE INVENTION

It is an object of the present invention to provide a one piece storage crate for hanging file folders.

It is a further object of the present invention to provide an apparatus for securing hanging file folders to the support structure.

These objectives are achieved hereby by a one piece, injection molded crate. The crate is rectangular in shape with two longitudinal sides, two lateral sides and a bottom portion. The two longitudinal sides contain a rectangular opening in the upper portion which defines a lower resilient support beam and an upper resilient securing beam.

DESCRIPTION OF THE PREFERRED EMBODIMENT

For purposes of this specification, the term "crate" is used generally and synonymously to mean carton, case or any other container suitable for storage.

Figure 1:
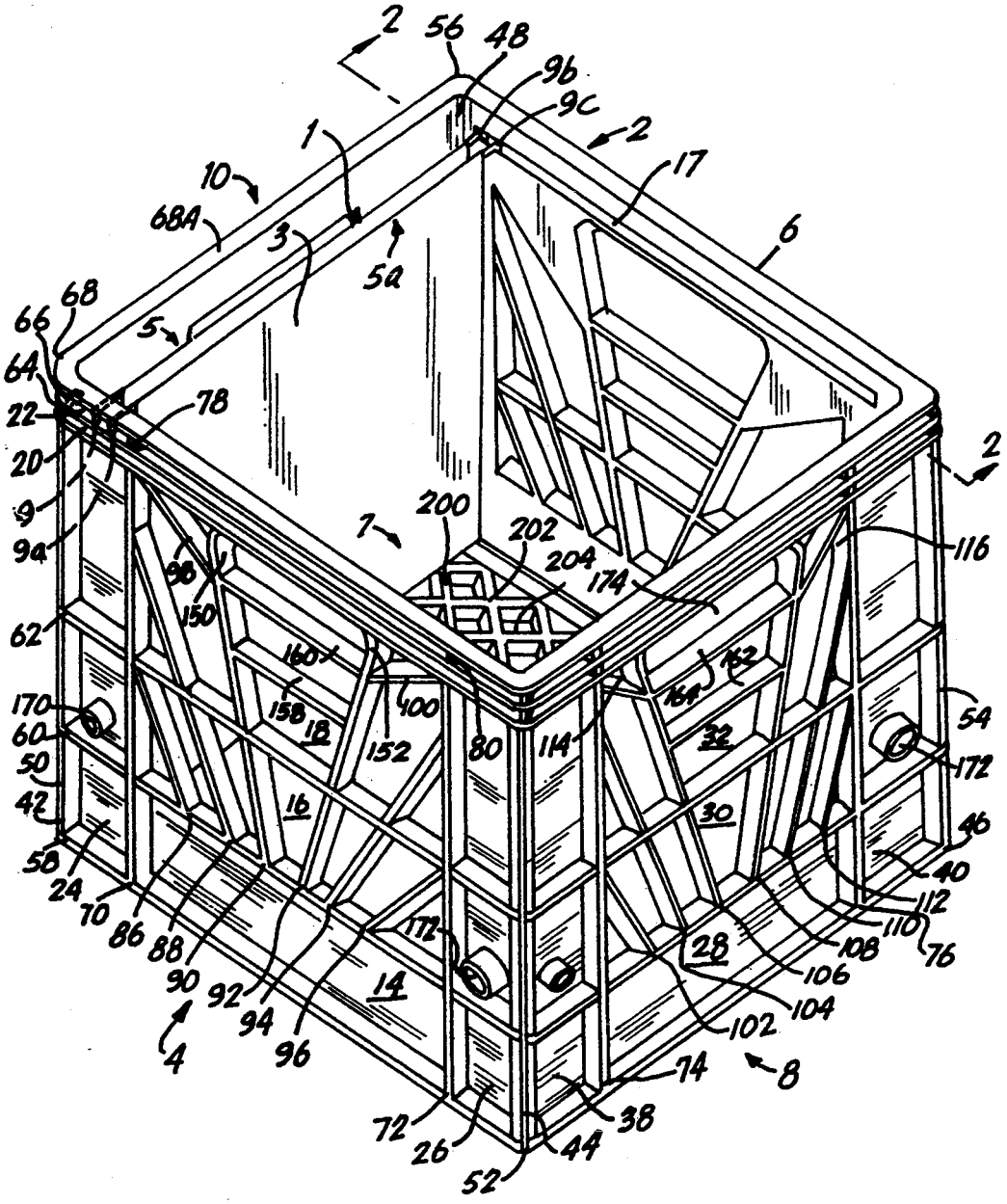
FIG. 1 is an isometric view of the crate of the present invention.

Referring to FIG. 1, the present invention comprises a rectangular crate, 2, with two longitudinal sides 4, and 6 and two lateral sides 8 and 10, a bottom 200, and a structure for supporting hanging file folders 1.

The hanging file folder is comprised of two support means 5 and 5*a* and a folder section 3. Each support means 5 and 5*a* terminates in a L-shaped hook 9, 9*a*, 9*b* and 9*c*. The folder section 3 extends downwardly from the support means and is folded along line 7.

Each longitudinal side 4 and 6 is similarly configured with a lower solid horizontal panel 14, two intermediate openings 16 and 18 dominating the sides, an upper solid horizontal panel 22 and an opening 17 for the reception of hanging file folders 1 in horizontal panel 20. Each longitudinal side 4 and 6 has solid vertical panels 24 and 26 which with the horizontal panels 14, 20 and 22 define the openings 16, 17 and 18.

Similarly, the lateral sides 8 and 10 are configured essentially the same as the longitudinal sides 4 and 6 with a lower horizontal panel 28, two intermediate openings 30 and 32 but with two upper solid horizontal panels 34 and 36. Solid vertical end panels 38 and 40 which with the horizontal panels 28, 34 and 36 define the openings 30 and 32.

The solid vertical end panels 24 and 26 of the longitudinal sides 4 and 6 are integrally formed with the respective solid vertical end panels 38 and 40 of the lateral sides 8 and 10 to provide four solid corner members 42, 44, 46 and 48.

The crate 2 is provided with a detailed rib structure as seen in FIG. 1 to afford durability and strength. The rib structure is integrally formed with the panel sections of the crate. The rib structure is comprised of four vertical ribs 50, 52, 54 and 56 extending vertically from each corner 42, 44, 46 and 48 of the crate 2, horizontal lower ribs 58 and 60, a horizontal intermediate rib 62 and horizontal upper ribs 64, 66 and 68. The horizontal ribs 58, 60, 62, 64, 66 and 68 are continuously formed around the crate 2.

In addition, two ribs 70 and 72 extend along the respective vertical edges of the longitudinal side openings 16 and 18. Two more vertical ribs 78 and 80 extend along the respective vertical edges of the solid horizontal planes 22 between horizontal ribs 66 and 68 of the longitudinal sides 4 and 6. Ribs 78 and 80 are oriented along the same axis as ribs 70 and 72, respectively. Illustratively, ribs 70 and 72 are seen in FIG. 1 extending from the bottom horizontal rib 58 along the vertical edge of the horizontal panel 14, along the vertical edges of openings 16 and 18 to horizontal rib 64. Ribs 78 and 80 are seen in FIG. 1 extending from horizontal rib 66 along the vertical edges of the solid horizontal panel 22 to horizontal rib 68.

Ribs 74 and 76 extend along the respective vertical edges of the lateral side openings 30 and 32. Illustratively, ribs 74 and 76 are seen in FIG. 1 extending from the bottom horizontal rib 58 along the vertical edge of the horizontal plane 28 along the vertical edges of openings 30 and 32 along the vertical edge of horizontal panels 20 and 22 to the horizontal rib 68.

In addition, eight ribs 86, 88, 90, 92, 94, 96, 98 and 100 extend diagonally from the respective vertical edges of the opening 16 and 18 on the longitudinal sides 4 and 6 of the crate 2. Similarly, eight ribs 102, 104, 106, 108, 110, 112, 116 and 118 extend diagonally from the respective vertical edges of openings 30 and 32 on the lateral sides 8 and 10 of the crate 2.

Illustratively, rib 86 is seen extending from the corner formed by horizontal rib 62 and the vertical rib 70 through opening 16 at about a 35° angle to the vertical rib 70 to a point along horizontal rib 60.

Rib 96 is seen extending from the corner formed by horizontal rib 62 and vertical rib 72 through opening 16 at about a 35° angle to vertical rib 72 to a point along horizontal rib 60.

Rib 88 is seen extending from a point along vertical rib 70 in opening 18 through opening 18 at about a 30° angle to vertical rib 70 continuing through opening 16 to a point along horizontal rib 60.

Rib 94 is seen extending from a point along vertical rib 72 in opening 18 through opening 18 at about a 30° angle to vertical rib 72 continuing through opening 16 to a point along horizontal rib 60.

Rib 90 is seen extending from a point along horizontal rib 64 through opening 18 at about a 70° angle to horizontal rib 64 to horizontal rib 62, continuing from horizontal rib 62 through opening 16 at about a 70° angle to horizontal rib 60. Rib 90 is provided with an upper curved portion 150 to follow the edge of opening 18.

Rib 92 is seen extending from a point along horizontal rib 64 through opening 18 at about a 70° angle to horizontal rib 64 to horizontal rib 62, continuing from horizontal rib 62 through opening 16 at about a 70° angle to horizontal rib 60. Rib 92 is provided with an upper curved portion 152 to follow the edge of opening 18.

Rib 98 is seen extending from the corner formed by upper horizontal rib 64 and vertical rib 70 through opening 18 at about a 60° angle to vertical rib 70 to a point along rib 90 forming a closed panel section 154.

Rib 100 is seen extending from the corner formed by horizontal rib 64 and vertical rib 72 through opening 18 at about a 60° angle to vertical rib 72 to a point along rib 92 forming a closed panel section 156.

Diagonal ribs 102, 104, 106, 108, 110, 112, 114 and 116 are found along the respective vertical edges of each of the sides 8 and 10 in the same manner as diagonal ribs 86, 88, 90, 92, 94, 96, 98 and 100 of longitudinal side 4 and 6.

In addition, each upper opening 18 and 32 has two substantially parallel horizontal ribs 158, 160, 162 and 164. Illustratively, horizontal ribs 158 and 160 extend horizontally from a point along rib 90 in opening 18 to a point along rib 92. Ribs 158 and 160 along with ribs 90 and 92 form the handle 174.

The solid vertical end panels 24 and 38 are provided with a peg 170 and the solid vertical end panels 26 and 40 are provided with a substantially round receptacle 172 capable of receiving the peg 170. The fitting of pegs 170 into receptacles 172 enables one crate to be securely stacked on top of another crate.

The top 68*a* of the crate 2, as best seen in FIG. 1, is the flat surface of the upper continuous rib 68.

The bottom 200 of the crate 2 as seen in FIG. 1 is formed in a mesh-like configuration with diagonally extending members 202 defining openings 204.

Figure 2:
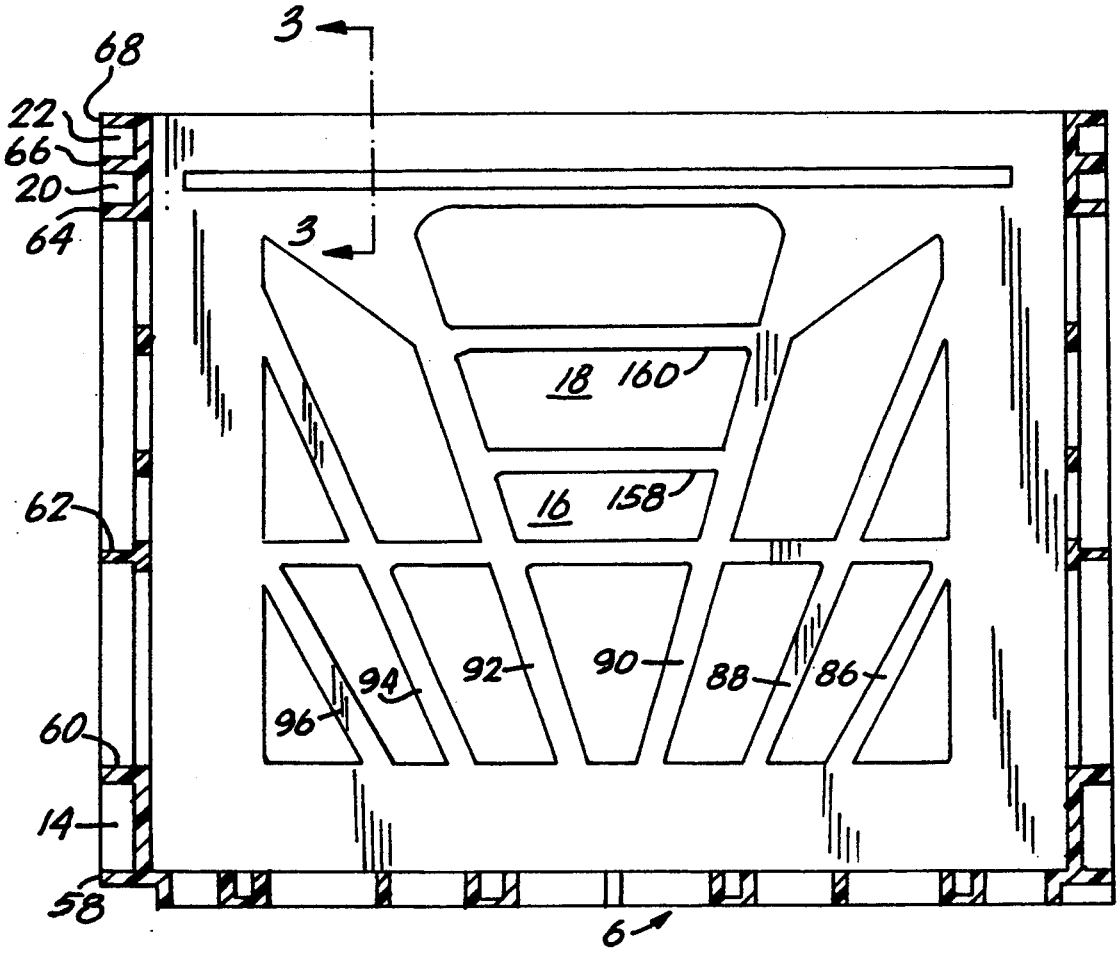
FIG. 2 is a side elevational view of the inner side of a longitudinal side of the crate of FIG. 1 taken through line 2—2 of FIG 1.

FIG. 2 is a view of the longitudinal side 6 taken from the inside of the crate 2 shown in FIG. 1 which provides a good perspective of the hanging file folder receptacle opening 17 found in the upper horizontal panel 20 of the longitudinal side 6.

Figure 3:
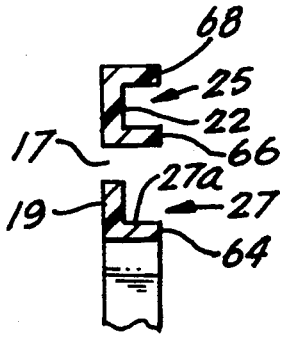
FIG. 3 is an upper cross sectional view of the longitudinal side of the crate taken along line 3—3 of FIG. 2.

The structure for supporting hanging file folders is best depicted in FIG. 3 which is an upper cross-sectional view of the longitudinal side of the crate taken along line 3—3 of FIG. 2. Opening 17 is located in the horizontal panel 20 between horizontal ribs 64 and 66 and extends downwardly from horizontal rib 66 a distance of 5/16". Opening 17 is 12" in length and is centrally located in the horizontal panel 20. Opening 17 forms a lip 19 out of horizontal panel 20 which extends upwardly 3/16" from horizontal rib 64. The lip 19 is 12" in length, ⅛" in width and centrally located on horizontal rib 64 on the longitudinal sides 4 and 6, of the crate 2.

The lip 19 along with horizontal rib 64 form the lower resilient support beam 27, while horizontal ribs 66 and 68 and horizontal panel 22 form the upper resilient securing beam 25. The lower resilient support beam 27 and upper resilient securing beam 25 are ½" in width.

Figure 4A:
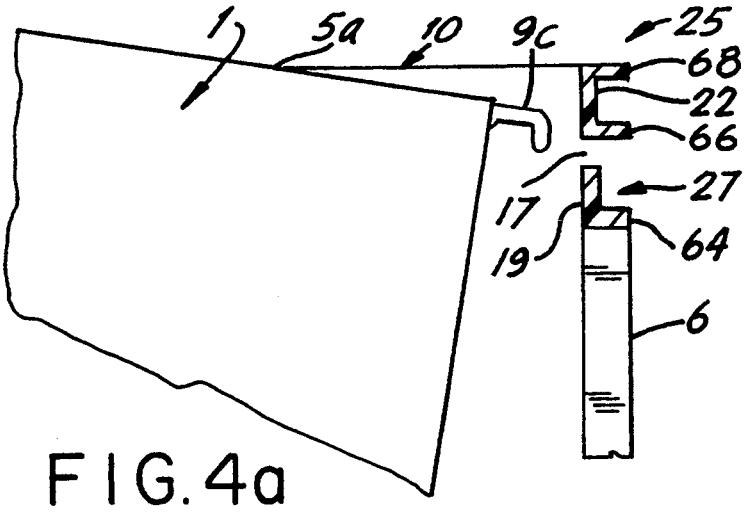
FIGS. 4*a*, 4*b* and 4*c* are the section of the crate as seen in FIG. 3 showing the insertion of a hanging file folder.
Figure 4B:
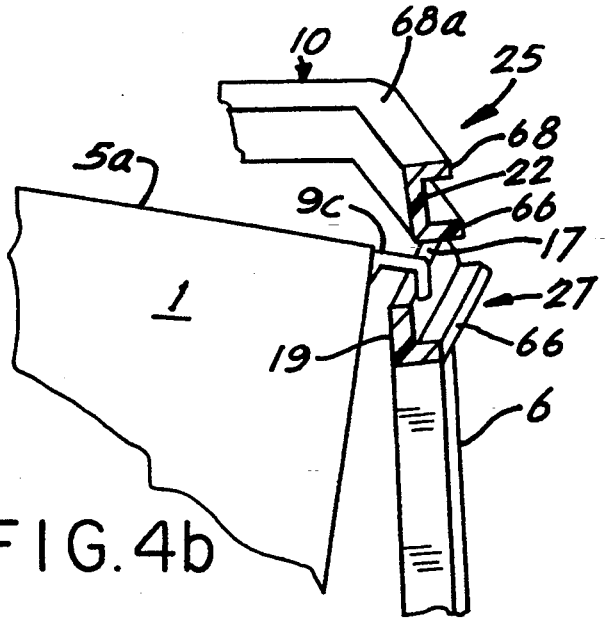
Figure 4C:
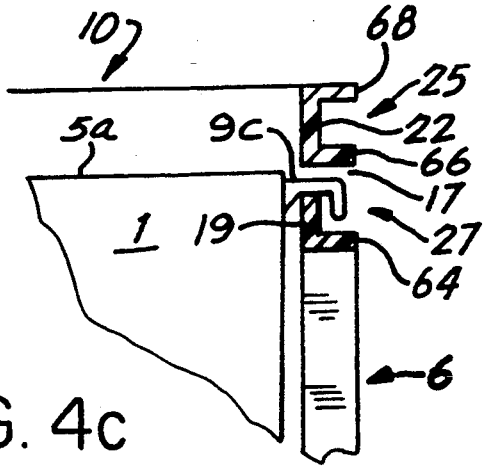

Opening 17 is configured to receive the L-shaped ends 9, 9*a*, 9*b* and 9*c* of hanging file folders 1. FIGS. 4*a*, 4*b* and 4*c* depict the L-shaped end, 9*c*, of a hanging file folder 1 being inserted into the support structure. FIG. 4*a* shows the support structure of FIG. 3 before the insertion of the hanging file folder 1. FIG. 4*b* shows the upper resilient securing beam 25 being forced outwardly while the lower resilient support beam 27 is simultaneously being forced inwardly to allow the L-shaped hook 9*c* to be inserted into opening 17 and eventually rest on the lower resilient support beam 27. The remaining L-shaped hooks 9, 9*a* and 9*b* are, inserted into the support structure by the same procedure. Once the L-shaped ends of a hanging file folder are inserted into opening 17 the force is removed from the lower resilient support beam 27 and upper resilient securing beam 25 allowing them to return to their former position defining the rectangular shape of the crate 2, and supporting and securing the hanging file folder 1 as seen in FIG. 4*c*.

To remove a hanging file folder 1 from the crate 2, the same procedure as described above for insertion is followed except the L-shaped hooks 9, 9*a*, 9*b* and 9*c* are removed from the opening 17 when force is exerted on the support structure.

The lower resilient support beam 27 supports the hanging file folders from resting on the bottom of crate 2 while allowing the hanging file folders to glide easily along the lower resilient support beam 27. Typically, the upper edge 27*a* of the lower resilient support beam 27 is 9½" above the bottom 200 of the crate 2 while a hanging file folder extends downwardly 9' from the bottom of the support means 5 and 5*a* to the fold line 7. The upper resilient securing beam 25 secures the hanging file folders to the lower resilient support beam 27 by preventing the L-shaped hooks 9, 9*a*, 9*b* and 9*c* of the file folder support from vertically disengaging from the lower resilient support beam 27. The hanging file folders 1 are prevented from horizontally disengaging with the lower resilient support beam 27 by lip 19 and the L-shaped hooks 9, 9a, 9b and 9c.

In a specific embodiment of the crate 2, the longitudinal sides 4 and 6 are 14¼" in length and the lateral sides are 13¼" in length. The overall height of the crate is 11". To facilitate the resiliency required in the structure, the crate 2 is composed of a copolymer of polypropylene such as Fortilene 4502, Fortilene 5801, Genesis AP 6112-HS or Genesis AP 6120-HS. The especially preferred copolymer is that manufactured by Shell as 7435. These preferred copolymers have a melt flow index at 230° C. in a range from 5–20 g/10 min., a flexural modulus ranging from 115,000 to 175,000 psi and a tensile strength at yield from 3200–4100 psi. The preferred method of manufacture at this time is by conventional injection molding.

The above specifications provide a crate with the resilience, strength and durability needed to practice the invention. Many variations of the present invention will suggest themselves to those skilled in the art in light of the above-identified description. All such obvious modifications are within the full intended scope of the claims.

I claim:

1. A one piece crate for storing hanging file folders comprising:

(a) two longitudinal sides;

(b) two lateral sides;

(c) a bottom; and (d) a hanging file folder support structure located in the upper portion of the longitudinal sides comprising:

(i) a lower resilient support beam for supporting the hanging file folders;

(ii) an upper resilient securing beam for securing the hanging file folders to the lower resilient support beam, wherein the lower resilient support beam and the upper resilient securing beam form an opening in the upper portion of the longitudinal sides of the crate that receives the support ends of the hanging file folders when the lower resilient support beam and the upper resilient securing beam are moved in opposing horizontal directions and the support structure supports the hanging file folders when the lower support beam and the upper resilient securing beam are allowed to return to their original position; and (iii) a lip that extends upwardly from the lower resilient support beam into the opening that receives the support ends of hanging file folders, which prevents the hanging file folders from horizontally disengaging from the lower resilient support beam.

2. A crate according to claim 1 further comprising means for reinforcing the crate comprised of (a) vertical ribs extending from the corner of the crate;

(b) continuous horizontal ribs comprised of:

(i) two horizontal lower ribs, one of said ribs being located at the bottom of the longitudinal and lateral sides;

(ii) a horizontal intermediate rib, being located approximately in the middle of the longitudinal and lateral sides; and (iii) three horizontal upper ribs, one of said ribs being located at the top of the longitudinal and lateral side walls;

(c) two vertical ribs on each of the longitudinal and lateral sides, which along with the upper of the two lower horizontal ribs and the lower of the three upper horizontal ribs define openings on the longitudinal and lateral sides; and (d) diagonal ribs which extend from the edges of the two vertical ribs on the longitudinal and lateral sides through the opening defined by the vertical ribs and the upper of the two lower horizontal ribs and the lower of the three upper horizontal ribs to the upper of the two lower horizontal ribs.

3. A crate according to claim 2 wherein the lower resilient support beam comprises a horizontal panel located between the lower horizontal rib of the three upper horizontal ribs and the middle horizontal rib of the three upper horizontal ribs and the lower horizontal rib of the three upper horizontal ribs wherein the opening that receives the support ends of the hanging file folders is a rectangular opening in said horizontal panel.

4. A crate according to claim 3 wherein said rectangular opening extends downwardly from the middle horizontal rib of the three upper horizontal ribs 5/16" and is 12" in length forming a 3/16" in height, ⅛" in width and 12" in length lip on the lower horizontal rib of the three upper horizontal ribs.

5. A crate according to claim 3 wherein said lower resilient support beam is at an elevation to support hanging file folders, above the bottom of the crate and prevent the hanging file folders from moving in a horizontal direction.

6. A crate according to claim 2 wherein said upper resilient securing beam comprises the middle horizontal rib of the three upper horizontal ribs, the top horizontal rib of the three upper horizontal ribs and a solid horizontal panel located between said middle horizontal rib and said top horizontal rib.

7. A crate according to claim 2 wherein the lower resilient support beam and upper resilient securing beam are ½" in width.

8. A crate according to claim 1 further comprising unitary longitudinal sides and the hanging file folder support structure is integrally formed in the unitary longitudinal sides.

9. A crate according to claim 8 further comprising the longitudinal sides formed of a resilient plastic material.

10. A crate according to claim 9 wherein the material for the crate is a copolymer of polypropylene having a melt flow index in the range of 5–20 g/10 min. at 230° C., a flexural modulus in the range of 115,000 to 175,000 psi and a tensile strength at yield in the range of 3200–4100 psi.

* * * * *